United States Patent [19]

Schuch

[11] 4,278,080

[45] Jul. 14, 1981

[54] DIVING SNORKEL

[75] Inventor: Joseph N. Schuch, Scarsdale, N.Y.

[73] Assignee: Under Sea Industries, Inc., Compton, Calif.

[21] Appl. No.: 3,509

[22] Filed: Jan. 15, 1979

[51] Int. Cl.[3] ..... A62B 7/00

[52] U.S. Cl. ..... 128/201.11

[58] Field of Search ..... 114/337; 128/142, 145 R, 128/145 A, 147, 201.11

[56] References Cited

U.S. PATENT DOCUMENTS

| | | | |
|---|---|---|---|
| 2,317,236 | 4/1943 | Wilen et al. | 128/145 A |
| 4,071,024 | 1/1978 | Blanc | 128/145 A |

*Primary Examiner*—Trygve M. Blix
*Assistant Examiner*—Jesús D. Sotelo
*Attorney, Agent, or Firm*—Flam & Flam

[57] ABSTRACT

A diving snorkel is provided with a purge valve located in a branch or bypass conduit. The branch conduit connects with the main snorkel conduit at a place remote from the mouthpiece. When the diver resumes a snorkel attitude after the snorkel has been filled with water, the purge valve allows water in the projecting end of the snorkel to drop to the level of the water surface, minimizing the amount of water required to be purged for snorkel breathing. The remote location of the purge valve provides efficient utilization of exhalation effort.

5 Claims, 7 Drawing Figures

DIVING SNORKEL

FIELD OF INVENTION

This invention relates to snorkels such as used by spear fishermen. More particularly, this invention relates to a mechanism for efficient purging of the water column for resumption of snorkel breathing.

DISCUSSION OF PRIOR ART

An experienced free diver using a snorkel maintains his face down underwater watch even as he returns to the surface level following a short dive. Such excursions or other maneuvers fill his snorkel tube with water that must be purged in order to resume snorkel breathing. Water is purged by producing a sharp blast of air. The water moves essentially as a near solid mass before the water has a chance to break apart and slip into the air stream. The exhalation effort required is considerable, but easily produced by a strong diver. But not all persons who use snorkels are capable. Consequently, there is a need of a simple mechanism for reducing the effort required to purge a snorkel.

One supposed solution is to provide a valve or "obturator" arrangement that automatically closes when the diver is submerged, thereby excluding water from the snorkel at all times. Such valves sometimes fail to seal. They also impose extra resistance against the required purging effort. Reliance upon such mechanisms proved to be hazardous. Such devices are not recommended and are obsolete.

Purge valves have been used with questionable success. Such purge valves are ordinarily located in the flow path, generally at the bottom of the snorkel tube adjacent the mouthpiece. The purge vavle allows the column of water in the snorkel tube to drop to the level of the surrounding water which otherwise would be trapped. Consequently, the volume of water that need be purged is reduced, but the purge valve provides an alternate path for the air. The energy of the air blast is dissipated to an extent dependent on the effective size of the purge valve. The smaller the purge valve size, the easier the purging will be, but the longer will it take to obtain the equalization of water levels upon resurfacing. With a reasonable valve size, the air intended to purge the system is largely purged. The air and water in the snorkel tube slip past each other resulting in residual or unpurged water. Some users pronounce the purge valve of no value while others consider it helpful. In any event, the known purge valve is far from a satisfactory solution. The problem is to find a way to provide a large size purge valve that does not detract from the purge effort.

SUMMARY OF INVENTION

In order to solve the problem, I provide a large purge valve at the end of a branch or bypass conduit that connects with the snorkel tube at a place spaced substantially from the snorkel mouthpiece. The remote location of the purge valve prevents the premature venting of air that the water is effectively purged before any significant slippage occurs between the impelling air and the impelled water.

BRIEF DESCRIPTION OF THE DRAWINGS

A detailed description of the invention will be made with reference to the accompanying drawings wherein like numerals designate corresponding parts in the several Figures. These drawings, unless described as diagrammatic or unless otherwise indicated, are to scale.

DETAILED DESCRIPTION OF PREFERRED EMBODIMENT

The following detailed description is of the best presently contemplated modes of carrying out the invention. This description is not to be taken in a limiting sense, but is made merely for purposes of illustrating the general principles of the invention since the scope of the invention is best defined by the appended claims.

Structural and operational characteristics attributed to forms of the invention first described shall also be attributed to forms later described, unless such characteristics are obviously inapplicable or unless specific exception is made.

The snorkel 10 includes a snorkel tube 12 open at its upper end to communicate with the air above the water surface. A conventional mouthpiece 14 is joined to the upwardly turned lower end of the snorkel. The snorkel tube 12 is curved to conform to the contour of the user's head. The tube may be provided with a D-shaped cross section in order to stabilize the snorkel against the user's face as in U.S. Pat. No. 3,603,306 to Bonin.

Figure 1:
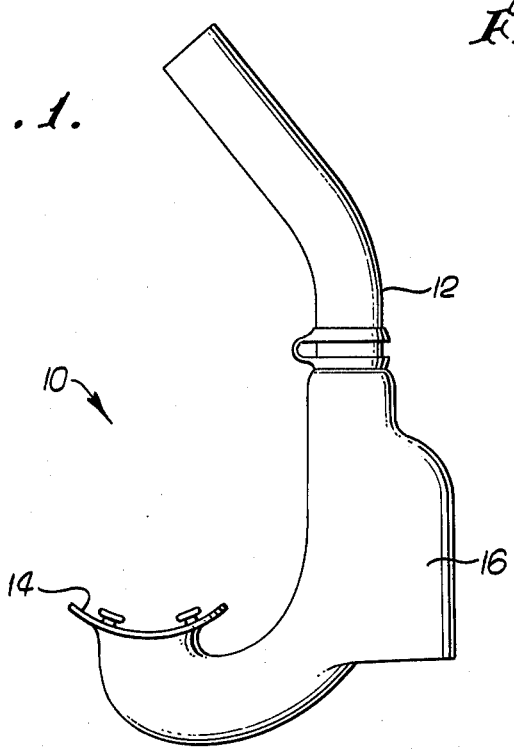
FIG. 1 is a front elevational view of a snorkel incorporating the present invention.
Figure 2:
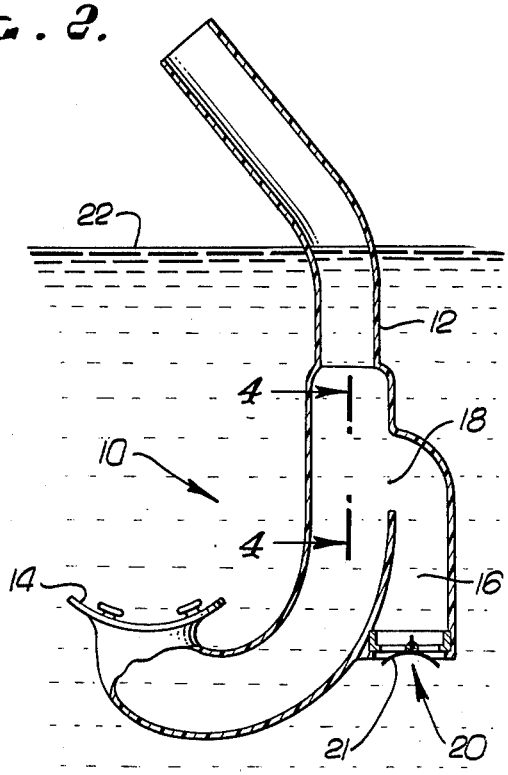
FIG. 2 is a longitudinal sectional view of the snorkel shown as the diver resurfaces, filled with water to the level of the surroundings.
Figure 3:
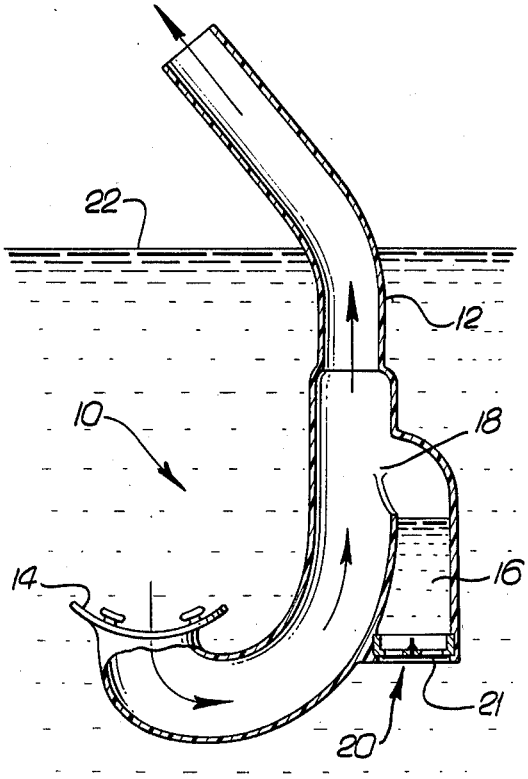
FIG. 3 is a view similar to FIG. 2 but shows the snorkel in the process of being purged.
Figure 4:
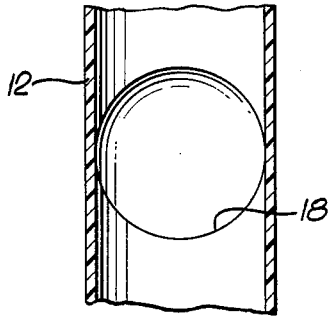
FIG. 4 is an enlarged fragmentary sectional view of the snorkel and taken along a plane corresponding to line 4—4 of FIG. 2.

The snorkel tube 12 is intersected at approximately its mid-length by a branch or bypass conduit 16 that extends downwardly approximately to the level of the mouth piece 14. A large area generally circular opening 18 connects near the top of the branch or bypass conduit to the side of the main snorkel conduit 12. A conventional check valve 20 is attached to the other end of the branch conduit 16 to block return of water to the branch conduit. The valve 20 has a delicate flapper 21 that requires only very slight pressure to open it. When the user surfaces (FIG. 2), following a dive or other maneuver, his snorkel tube 12 is ordinarily filled with water. Any water that might otherwise exist in the upper end of the snorkel tube that extends above the surface 22 transmits pressure to the non-return valve 20, causing it to open, draining the water in the snorkel tube until the level equalizes to that of the surface 22. Since the opening 18 is quite large, and since the non-return valve 20 offers little resistance to flow, the equalization of levels takes place before any measurable quantity of water can be lifted as the snorkel breaks the surface.

To restore snorkel breathing while the user is face down and at the surface, air is blasted through the tube by a sharp exhalation effort. The column moves upwardly. By the time the bottom of the rising water column reaches the level of the bypass opening 18, it has upward momentum. Some of the air diverts into the bypass to force the water downwardly. Long before the air completely purges water from the bypass conduit 16, the column of water in the main snorkel tube has been lifted beyond the top of the snorkel. Thus, the water in the bypass conduit 16 provides resistance sufficient to ensure efficient application of air pressure to the main column of water in the snorkel tube 12. The purging is completed before air reaches the non-return or check valve 20.

During normal snorkel breathing, the main snorkel tube will be essentially free of water with slight water collections forming at the turned bottom of the snorkel beneath the mouthpiece. Water in the branch conduit will be well below the level of the opening 18 during normal snorkel breathing.

The improved snorkel has the advantage of the conventional simple snorkel in that the blast of air is not attenuated by actual flow through a purge valve. It also has the advantage of a conventional purge valve snorkel in that the snorkel tube is quickly and automatically drained to the level of the surrounding water.

The improved snorkel can be molded in one piece or fabricated of several pieces. The most compact arrangement is one in which the branch conduit 16 generally parallels the lower end of the main snorkel tube 12 with one wall in common. It need not extend to the bottom of the snorkel, and can be somewhat shorter. Many orientations of the branch conduit are possible as long as it connects to the main snorkel conduit 12 at a place located distant from the mouthpiece but below that part of the snorkel that will project above the water in the face down surfaced position of the user. The branch conduit 16 must have sufficient length to provide the transient resistance necessary to cause purging of the main snorkel tube 12 before air reaches the check valve 20.

DESCRIPTION OF ALTERNATIVE EMBODIMENT

Figure 5:
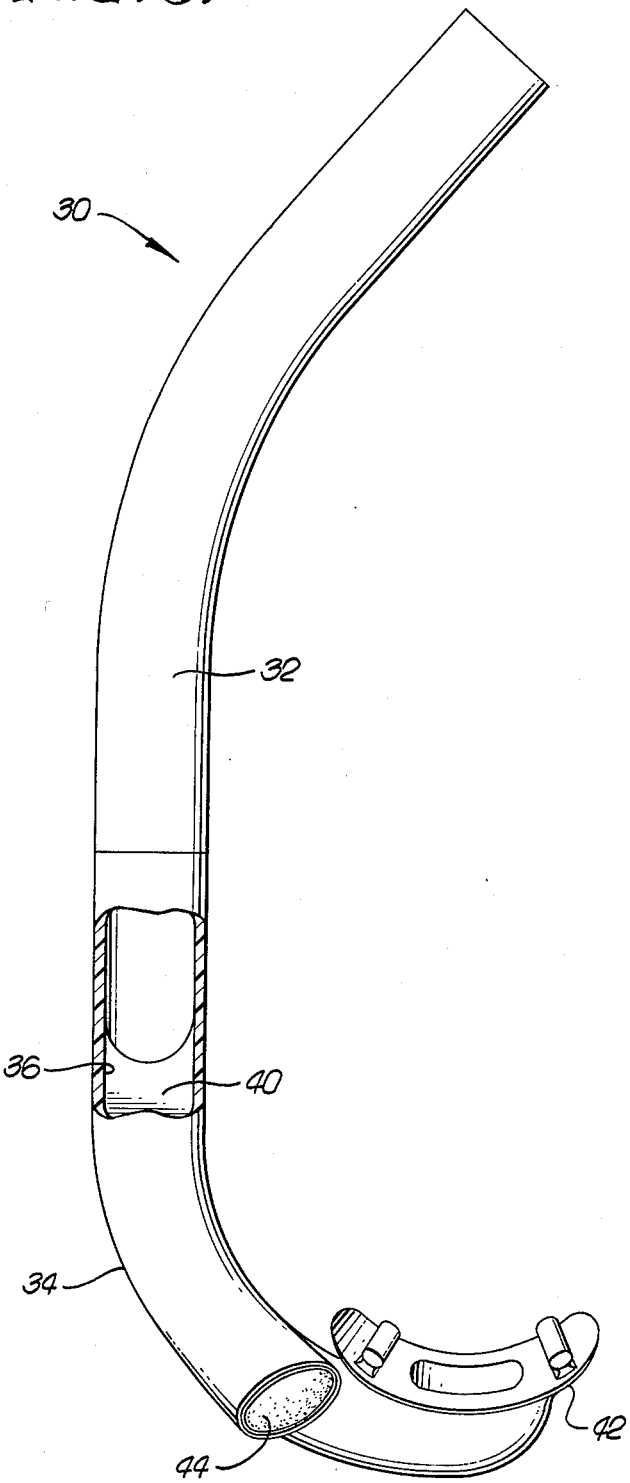
FIG. 5 is a front elevational view illustrating an alternative snorkel structure.
Figure 7:
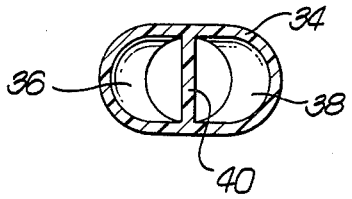
FIG. 7 is a transverse sectional view taken along a plane corresponding to line 7—7 of FIG. 6.
Figure 6:
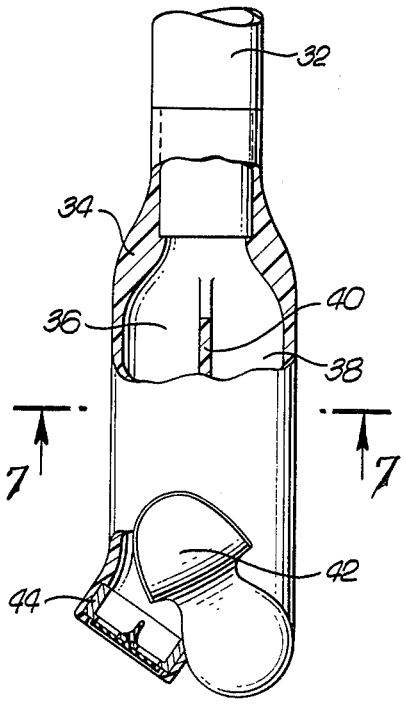
FIG. 6 is a side elevational view of the snorkel shown in FIG. 5, part of the snorkel being broken away and shown in section.

The snorkel 30 shown in FIGS. 5, 6 and 7 is made in two parts: a snorkel stack 32 and a molded lower body 34. The molded lower body 34 provides two side by side conduits 36 and 38 divided by a septum 40. The septum 40 has a free upper edge whereby the conduits 36 and 38 are in communication at their upper ends. The snorkel stack 32 telescopes into the upper end of the body 34 for communication with both conduits 36 and 38.

The lower end of one of the conduits 38 is connected to a mouthpiece 42 to form the main snorkel channel while the lower end of the companion conduit 36 opens to the ambient through a non-return valve 44 fitted thereto to form the branch conduit. The conduits 36 and 38 are oriented so that the outer walls of both conduits contact the diver's cheek, whereas the branch conduit of the snorkel of FIGS. 1 to 4 is located directly outboard of the main snorkel conduit.

The operation of the snorkel of FIGS. 5 to 7 is the same as that of the snorkel of FIGS. 1 to 4. Only the configuration of parts is changed.

Intending to claim all novel, useful and unobvious features shown or described, I make the following claims:

1. In a snorkel structure:

(a) means forming a main snorkel conduit having an unobstructed, unrestricted opening at the top for conducting ambient air to the snorkel conduit when the top of the snorkel conduit projects above the water surface and which allows water to enter when the top of the snorkel conduit is beneath the water surface;

(b) a mouthpiece at the bottom of the snorkel conduit;

(c) a bypass conduit having a first opening connected to the main snorkel conduit at a place spaced substantially from and above said mouthpiece along the snorkel conduit and located between the mouthpiece and the top of the snorkel conduit;

(d) said bypass conduit having a second opening spaced from said first opening located beneath said first opening automatically to drain excess trapped water from the projecting end of the snorkel upon resurfacing following a dive or other maneuver;

(e) a non-return purge valve located at said second opening to block flow of water into said bypass conduit and therethrough to said snorkel conduit; and (f) said purge valve being located distant from said mouthpiece whereby a burst of purge air is applied to the water entrapped in the snorkel conduit to lift it out of the snorkel before air vents through the purge valve.

2. The snorkel as set forth in claim 1 in which said bypass conduit generally parallels the lower end of said snorkel conduit, there being a common wall between the bypass conduit and said snorkel conduit.

3. The combination as set forth in claim 1 in which the downward extent between said first and second openings imposes resistance to movement of air to the purge valve sufficient to ensure efficient purging.

4. In a snorkel structure:

(a) means forming a main snorkel conduit having an unobstructed, unrestricted opening at the top for conducting ambient air to the snorkel conduit when the top of the snorkel conduit projects above the water surface and which allows water to enter when the top of the snorkel conduit is beneath the water surface;

(b) a mouthpiece at the bottom of the snorkel conduit;

(c) said snorkel conduit having a configuration to provide a substantially smooth flow path between said top opening and said mouthpiece which is essentially free of abrupt changes in path direction;

(d) a bypass conduit having a first opening connected to said main snorkel conduit at a place located beneath the water surface during normal snorkeling and which is spaced substantially from and above said mouthpiece along the snorkel conduit;

(e) said bypass conduit having a second opening spaced from said first opening and located beneath said first opening automatically to drain excess trapped water from the projecting end of the snorkel conduit upon resurfacing following a dive or other maneuver;

(f) a non-return purge valve located at said second opening to block flow of water into said bypass conduit and therethrough to said snorkel conduit;

(g) said purge valve being located sufficiently distant from said mouthpiece such that the column of water entrapped in the main snorkel conduit is bound by a sharp exhalation effort to move entirely out of the snorkel conduit by the time that the column of water passes the said first opening of the bypass conduit.

5. The combination as set forth in claim 4 in which said bypass conduit generally parallels said main snorkel conduit and extends downwardly from its said first opening whereby the direction of said bypass conduit offers an impedance to the flow of the water column being purged from the main snorkel conduit.

* * * * *